US008074833B2

(12) United States Patent
Yang et al.

(10) Patent No.: US 8,074,833 B2
(45) Date of Patent: Dec. 13, 2011

(54) TRASH CAN ASSEMBLY WITH LOCKING LID

(75) Inventors: Frank Yang, Rancho Palos Verdes, CA (US); Joseph Sandor, Santa Ana Heights, CA (US)

(73) Assignee: Simplehuman LLC, Torrance, CA (US)

( * ) Notice: Subject to any disclaimer, the term of this patent is extended or adjusted under 35 U.S.C. 154(b) by 1098 days.

(21) Appl. No.: 11/724,677

(22) Filed: Mar. 14, 2007

(65) Prior Publication Data

US 2007/0205195 A1 Sep. 6, 2007

Related U.S. Application Data

(63) Continuation-in-part of application No. 11/007,100, filed on Dec. 7, 2004, now Pat. No. 7,559,433, which is a continuation-in-part of application No. 10/828,067, filed on Apr. 19, 2004, now Pat. No. 7,086,550.

(51) Int. Cl.
*B65D 43/24* (2006.01)

(52) U.S. Cl. ..... 220/831; 220/832; 220/262; 220/263; 220/908

(58) Field of Classification Search ..... 220/831, 220/832, 908, 262, 263, 264
See application file for complete search history.

(56) References Cited

U.S. PATENT DOCUMENTS

| | | | | | |
|---|---|---|---|---|---|
| 881,492 | A * | 3/1908 | Schiller | 217/60 C |
| 1,891,651 | A * | 12/1932 | Padelford et al. | 220/263 |
| 2,563,456 | A * | 8/1951 | Brownell | 220/263 |
| 3,008,604 | A * | 11/1961 | Garner | 220/87.1 |
| 3,959,859 | A * | 6/1976 | Stein et al. | 27/18 |
| 4,460,105 | A * | 7/1984 | Cox | 220/830 |
| 4,972,966 | A * | 11/1990 | Craft, Jr. | 220/264 |
| 5,249,693 | A * | 10/1993 | Gillispie et al. | 220/263 |
| 5,511,807 | A * | 4/1996 | Snyder | 280/47.26 |
| 5,516,168 | A * | 5/1996 | Tomaszewski-Link | 292/338 |
| 5,570,493 | A * | 11/1996 | Gulick | 27/18 |
| 5,639,002 | A * | 6/1997 | Weitbrecht et al. | 224/539 |
| 5,868,448 | A * | 2/1999 | Izumo | 296/37.1 |
| 6,000,569 | A * | 12/1999 | Liu | 220/263 |
| 6,010,024 | A * | 1/2000 | Wang | 220/23.87 |
| 6,626,316 | B2 * | 9/2003 | Yang | 220/263 |
| 6,626,317 | B2 * | 9/2003 | Pfiefer et al. | 220/263 |
| 6,668,422 | B2 * | 12/2003 | Tolmei | 16/82 |
| 7,073,213 | B2 * | 7/2006 | Duarte et al. | 4/498 |
| 7,086,550 | B2 * | 8/2006 | Yang et al. | 220/263 |
| 7,559,433 | B2 * | 7/2009 | Yang et al. | 220/832 |
| 2001/0020619 | A1 * | 9/2001 | Pfeifer et al. | 220/263 |
| 2002/0000022 | A1 * | 1/2002 | Schillaci et al. | 16/319 |

* cited by examiner

*Primary Examiner* — Anthony Stashick
*Assistant Examiner* — Christopher McKinley
(74) *Attorney, Agent, or Firm* — Raymond Sun

(57) ABSTRACT

A trash can assembly has a shell and a lid fitted over the top end of the shell, with the lid having a bracket secured to the bottom of the lid. A slot provided adjacent the top of the shell, with the bracket moving through the slot as the lid is opened and closed. A movable lock member provided at the top of the shell, the lock member movable from an extended position where the lock member covers a portion of the slot, to a retracted position where the lock member is clear of the slot.

16 Claims, 8 Drawing Sheets

48
28
58
XI
44
42
50
60
46
40
52
62
56
32

28
58
60
44
42
42
40
56
62
52
32

TRASH CAN ASSEMBLY WITH LOCKING LID

RELATED CASES

This is a continuation-in-part of Ser. No. 11/007,100 filed Dec. 7, 2004 now U.S. Pat. No. 7,559,433, which is in turn a continuation-in-part of Ser. No. 10/828,067, filed Apr. 19, 2004 now U.S. Pat. No. 7,086,550, whose disclosures are incorporated by this reference as though fully set forth herein.

BACKGROUND OF THE INVENTION

1. Field of the Invention

The present invention relates to household items, and in particular, to a trash can assembly that allows for convenient use.

2. Description of the Prior Art

A major concern for both the home and the workplace is containing and holding wastes, refuse, and trash until permanent disposal. Trash cans act as containers for holding trash and other wastes that are produced in any typical home or office. Trash and garbage cans often employ lids and covers to contain the trash and its associated odor, to hide the trash from view, and to prevent the trash from contaminating areas beyond the lid.

Conventional trash cans have been improved over the years to make them more user-friendly, sanitary, and hygienic. For example, many trash cans are now provided with a foot pedal positioned adjacent the base of the trash can so that a user can step on the foot pedal to open the lid of the trash can, thereby freeing up the user's hands to toss trash, or to change the plastic liner or bag that is used to line the trash can.

Unfortunately, to keep the lid open, the user must keep his or her foot on the pedal. If the user needs to move away from the trash can to get additional trash, or to get a new liner, the lid will slam shut. In addition, if the user is attempting to sort the contents inside the trash can, or searching for something that may have been inadvertently tossed into the trash can, it can be uncomfortable and inconvenient for the user to keep his or her feet on the pedal while maneuvering the hands inside the trash can.

Thus, there remains a need for a trash can that allows for convenient use thereof.

SUMMARY OF THE DISCLOSURE

It is an object of the present invention to provide a trash can assembly that allows the user to use the trash can more conveniently.

It is another object of the present invention to provide a trash can assembly where the lid can be temporarily locked in an opened position.

In order to accomplish the objects of the present invention, there is provided a trash can assembly that has a shell, a lid fitted over the top end of the shell, with the lid having a bracket secured to the bottom of the lid. A slot provided adjacent the top of the shell, with the bracket moving through the slot as the lid is opened and closed. A movable lock member provided at the top of the shell, the lock member movable from an extended position where the lock member covers a portion of the slot, to a retracted position where the lock member is clear of the slot.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Figure 1:
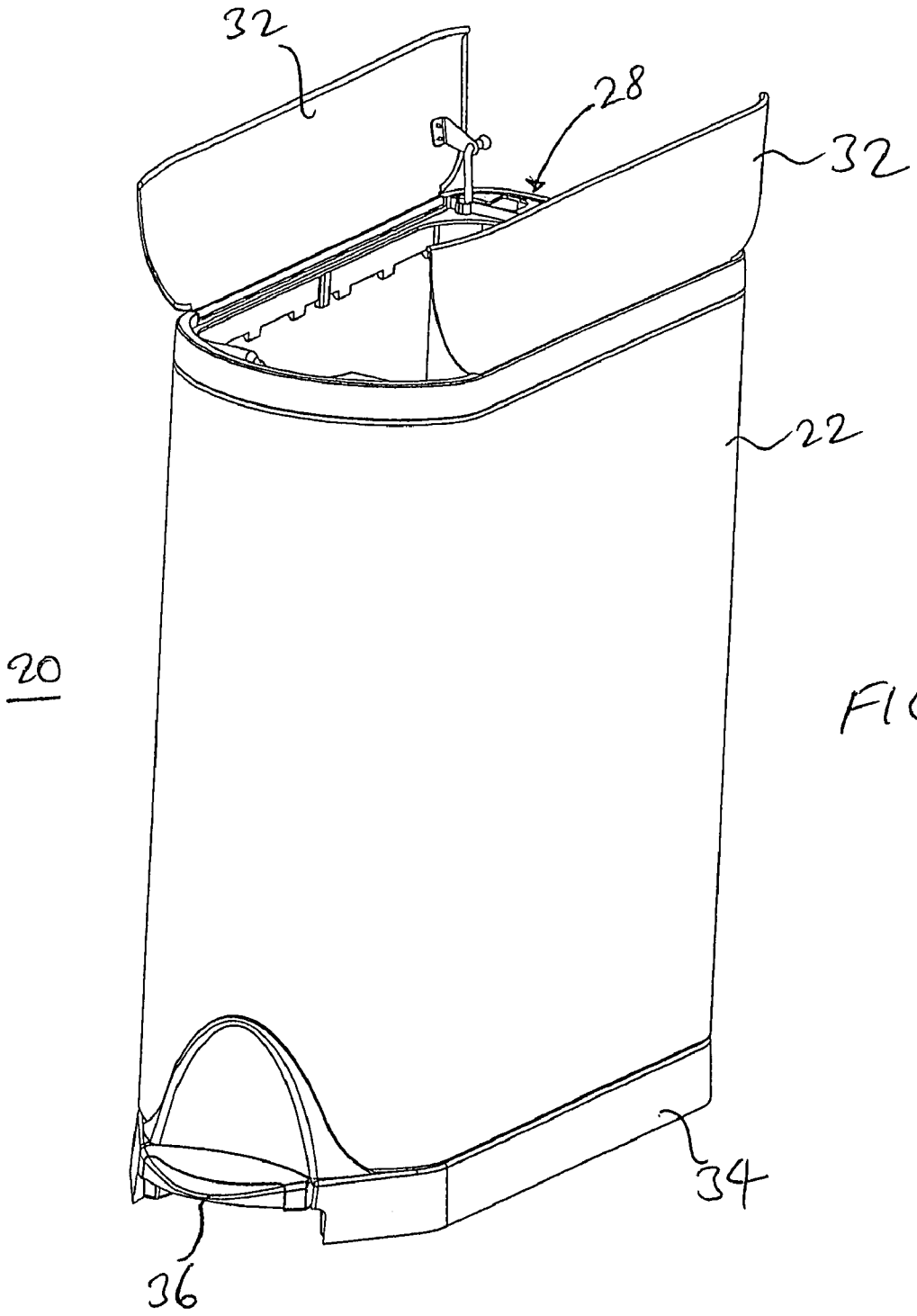
FIG. 1 is a perspective view of a trash can assembly according to one embodiment of the present invention shown with the lid opened.
Figure 2A:
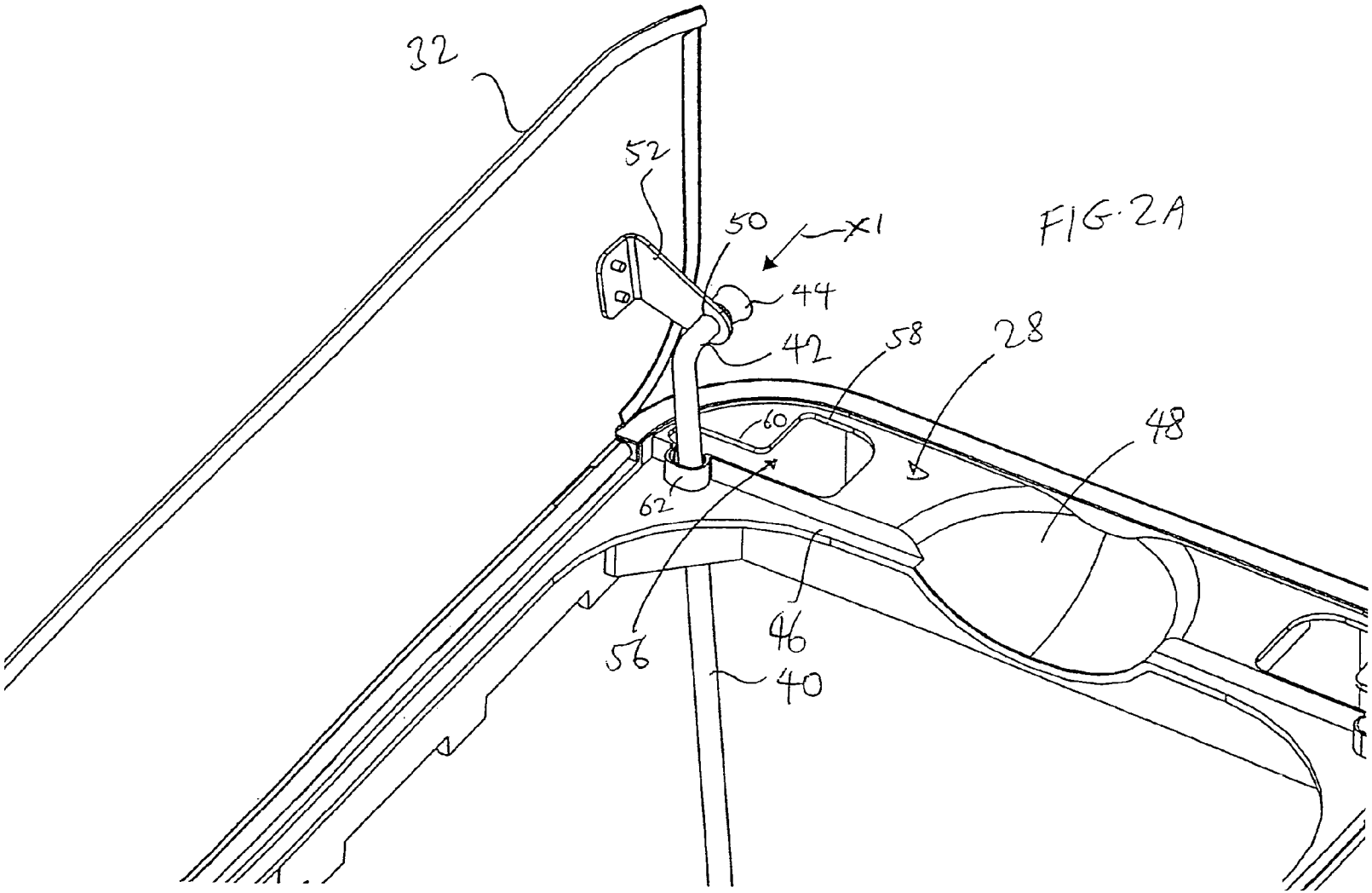
FIGS. 2A-2E are perspective views illustrating the operation of the locking mechanism of the lid for the trash can assembly of FIG. 1.
Figure 2B:
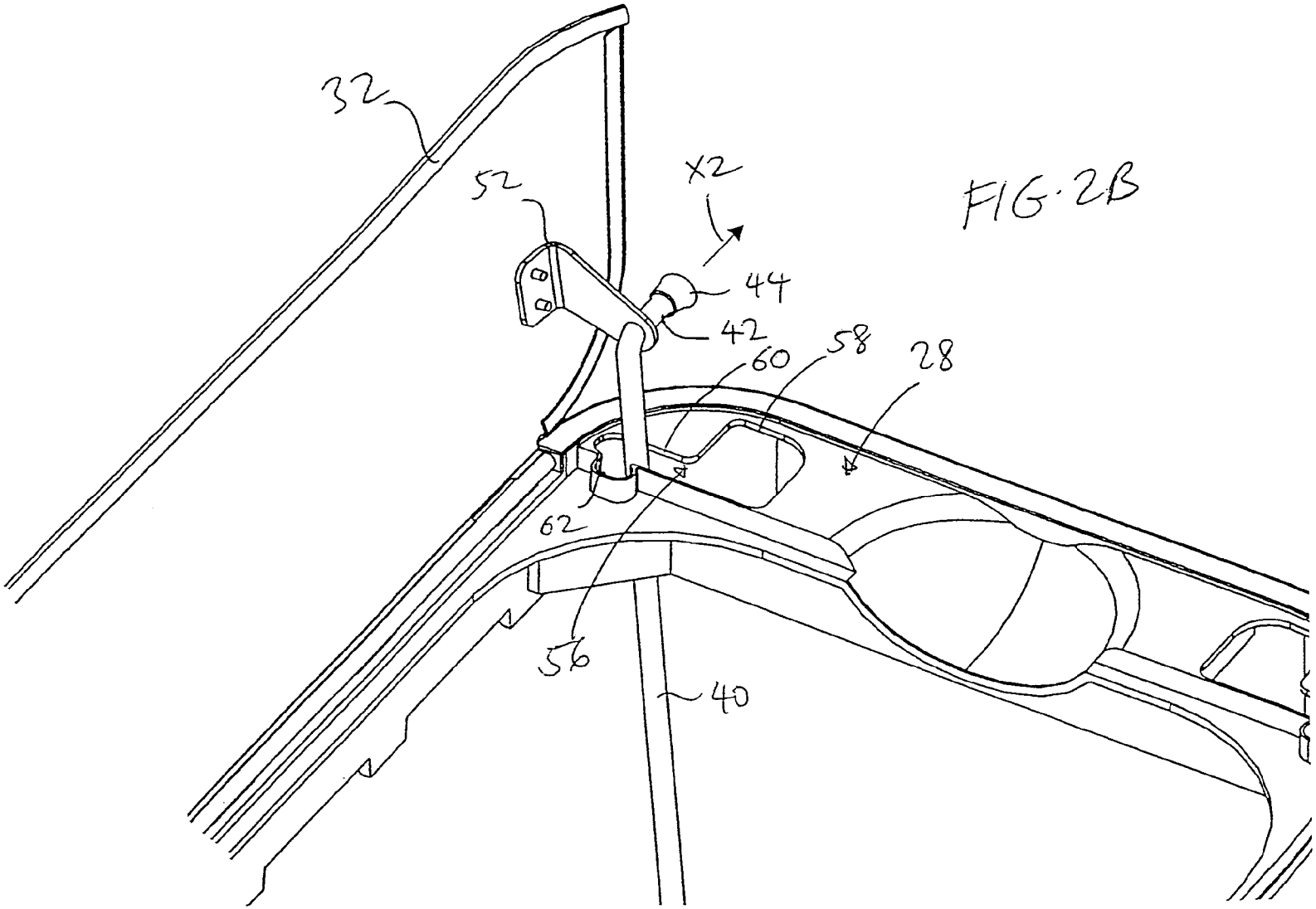
Figure 2C:
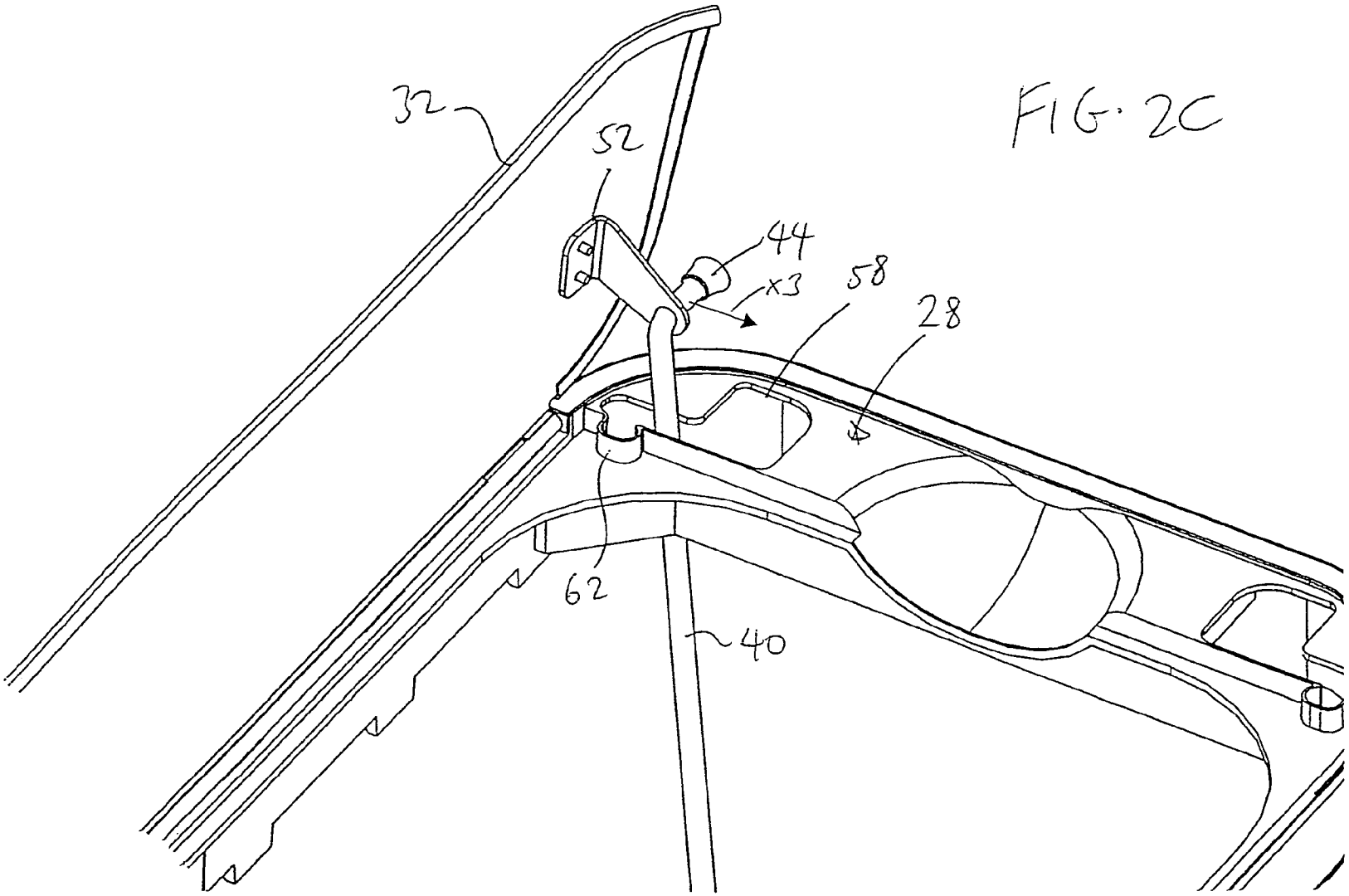
Figure 2D:
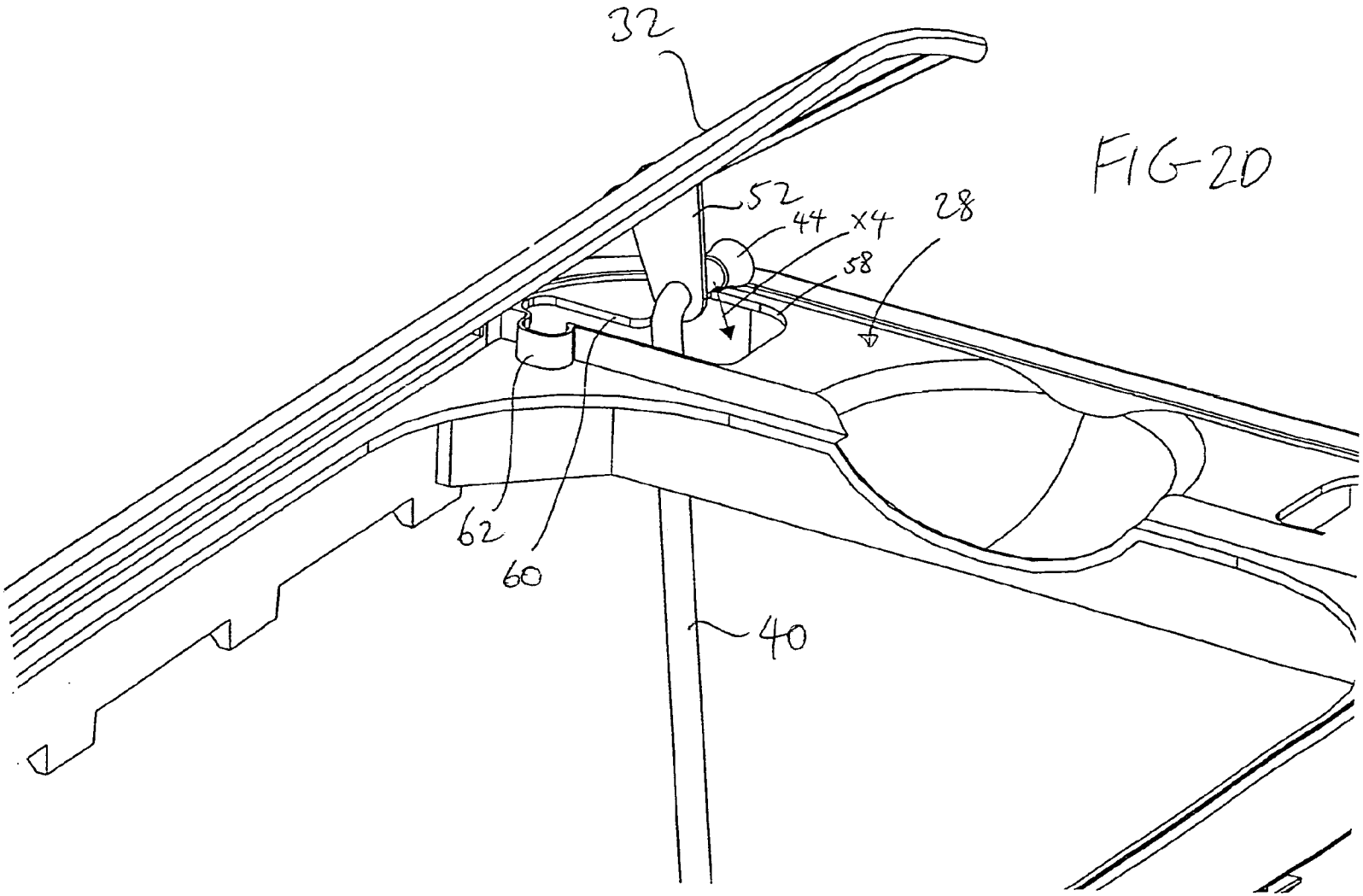
Figure 2E:
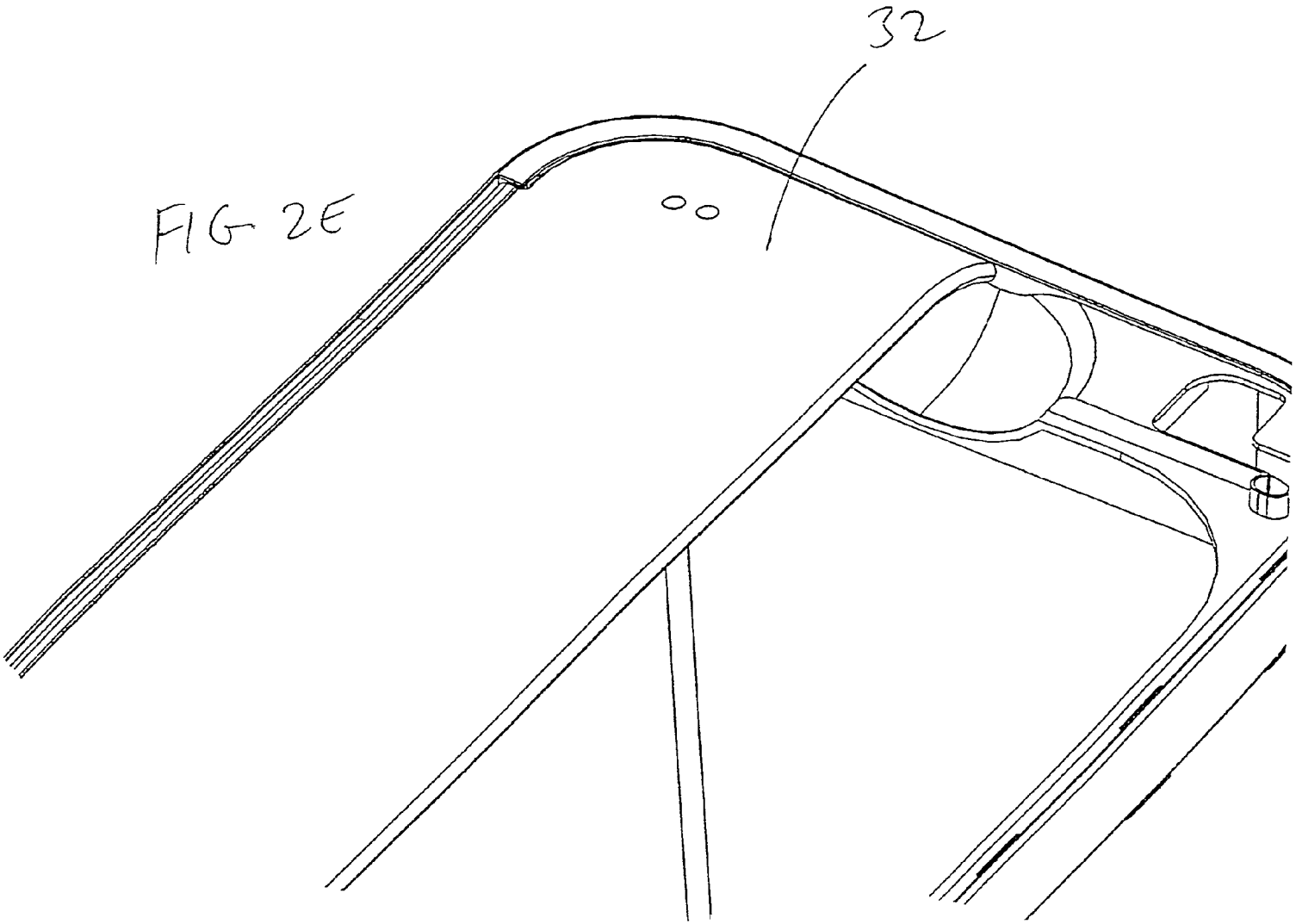
Figure 3:
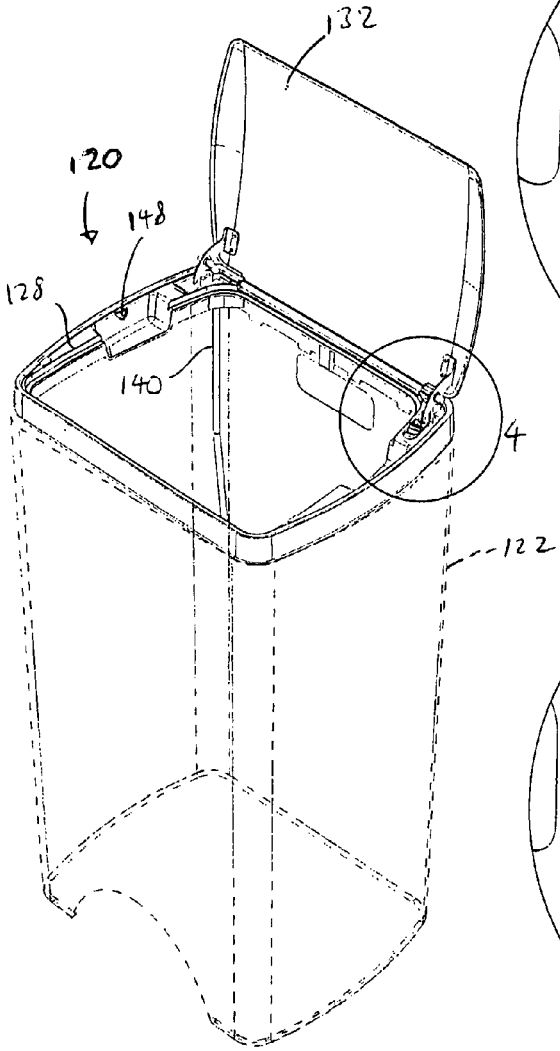
FIG. 3 is a perspective view of a trash can assembly according to another embodiment of the present invention shown with the lid opened.

FIGS. 1-2E illustrate one embodiment of a trash can assembly 20 according to the present invention. The assembly 20 has a shell 22 and an internal liner (not shown) that is adapted to be retained inside the shell 22. The shell 22 can be made from either plastic or metal. The liner is essentially a container, and can also be made from either plastic or metal. The shell 22 is an enclosing wall which can have any desired shape, including oval, triangular, rectangular, square or circular (among others). The liner can have the same shape as the shell 22. An upper support frame 28 can be secured to the opened top of the shell 22, and can be provided in a separate material (e.g., plastic if the shell 22 is metal) from the shell 22.

A pair of lids 32 is hingedly connected to the upper support frame 28 using hinged connections that are well-known in the art, and will not be described in greater detail herein. As one non-limiting example, each lid 32 can be hingedly connected to the shell 22 in the manner that is described in U.S. Publication No. US-2004-0004080-A1, published on Jan. 8, 2004 and entitled "Trash Can Assembly", whose entire disclosure is incorporated by this reference as though set forth fully herein. The shell 22 and its lids 32 can be made of a solid and stable material, such as a metal. The shell 22 has a base 34, and a foot pedal 36 is pivotably secured to the base 34.

A link assembly extends from the foot pedal 36 along the base 34 and then upwardly along the rear of the shell 22 to the upper support frame 28 and each lid 32. The link assembly operates to translate an up-down pivot motion of the pedal 36 to a corresponding up-down pivot motion for each lid 32. The construction and operation of link assemblies are well-known in the art, and will not be described in greater detail herein. As one non-limiting example, the link assembly, foot pedal 36 and the lids 32 can be constructed in accordance with that which is described in U.S. Publication No. US-2004-0004080-A1, published on Jan. 8, 2004 and entitled "Trash Can Assembly".

The link assembly includes a pair of link rods 40, with each rod 40 extending from the base 34 upwardly along one edge of the rear of the shell 22 to the upper support frame 28 so that each rod 40 is aligned with a rear corner of the lid 32 (see FIG. 1). Only one link rod 40 and its accompanying hinge components are shown in FIGS. 1-2E, but both pairs of link rods 40 and their accompanying hinge components are the same. Referring to FIGS. 2A-2D, each link rod 40 has a hooked end 42 that is adapted to be inserted through a hole 50 in an L-shaped bracket 52 that is fixedly secured (e.g., by screws) to the underside of each lid 32 at a corner of the lid 32. The hooked end 42 has a length that allows it to experience back and forth sliding motion within the hole 50 in the bracket 52. However, an enlarged stop member 44 is provided at the end of the hooked end 42 to prevent the hooked end 42 from being disengaged from the hole 50, and for the user to push against. Thus, pressing and releasing the pedal 36 will cause the upper hooked end 42 of each link rod 40 to move up and down, respectively, thereby opening and closing (via the force of gravity) the lid 32, which is well-known in the art.

The support frame 28 has an L-shaped slot 56 provided at each rear corner of the shell 22. Each slot 56 is sized and configured to allow the bracket 52 to extend therethrough and into the interior of the shell 22. In particular, each slot 56 has a leg section 58 that has a width which is slightly greater than the length of the hooked end 42. Each slot 56 also has an elongate section 60 extending from the leg section 58, with a generally semi-circular lock section 62 extending to a side of the elongate section 60 that is opposite to the side to which the leg section 58 extends.

The upper support frame 28 has an annular recessed wall 46. One or more cut-outs or grooves 48 are spaced-apart about the wall 46. The grooves 48 allow the user to insert his or her fingers through the grooves 48 under the upper lip of the internal liner to lift the internal liner from the interior of the shell 22 when the lids 32 are opened. This provides a convenient way for the user to remove the internal liner from the shell 22, without requiring the user to place his or her hands inside the internal liner to grip the internal liner.

FIGS. 2A-2E illustrate how each lid 32 can be locked in an open position. FIG. 2A illustrates the lid 32 locked in the open position. This locked open position is obtained by the user stepping on the foot pedal 36, which causes the hooked end 42 to push the bracket 52 and the lid 32 upwardly. The user then pushes the stop member 44 inwardly in the direction of the arrow X1 to secure the rod 40 into the lock section 62 of the slot 56. Thus, the lock section 62 functions as a locking member that secures the rod 40 in a raised position to lock the lid 32 in an opened position.

When the user wishes to close the lid 32, the user disengages the rod 40 from the lock section 62. This can be accomplished by pulling the stop member 44, or pushing the top of the rod 40, outwardly in the direction of the arrow X2, as shown in FIG. 2B. The rod 40 will become disengaged from the lock section 62 and will enter the elongate section 60 of the slot 56. At this time, the weight of the lid 32 (coupled with the force of gravity) will push the rod 40 and hooked end 42 downwardly as the lid 32 pivots downwardly, causing the rod 40 and hooked end 42 to move in the elongate section 60 towards the leg section 58 in the direction of the arrow X3, as shown in FIG. 2C. The weight of the lid 32 (coupled with the force of gravity) will eventually push the rod 40 and hooked end 42 downwardly into the leg section 58, where the hooked end 42 will begin a downward motion into the interior of the shell 22 in the direction of the arrow X4, as shown in FIG. 2D. Then, as shown in FIG. 2E, the lid 32 will eventually pivot downwardly until it completely covers the top of the shell 22 in a closed position. In this closed position, the rod 40, the hooked end 42 and the bracket 52 are all retained in the interior of the shell 22.

To open the lid 32 again, the user merely steps on the foot pedal 36, which causes the hooked end 42 to push the bracket 52 and the lid 32 upwardly. The rod 40, the hooked end 42, the bracket 52 and the lid 32 will experience the same motion, in reverse manner, as described above in connection with FIGS. 2D, 2C and 2B. When the rod 40 and the lid 32 reach the position shown in FIG. 2A, the user then pushes the stop member 44 inwardly in the direction of the arrow X1 to secure the rod 40 into the lock section 62 of the slot 56.

FIGS. 3-5B illustrate another embodiment of a trash can assembly 120 according to the present invention. The assembly 120 has a shell 122 and an internal liner (not shown) that is adapted to be retained inside the shell 122. The shell 122 and the liner can be the same as the shell 22 and the liner described above in connection with the embodiment of FIGS. 1-2E. An upper support frame 128 can be secured to the opened top of the shell 122, and can be the same as the support frame 28.

A lid 132 is hingedly connected to the upper support frame 128 using hinged connections that are well-known in the art, and will not be described in greater detail herein. The shell 122 and its lid 132 can be made of a solid and stable material, such as a metal. The shell 122 also has a foot pedal (not shown, but can be the same as 36 above) that is pivotably secured to a base (not shown, but can be the same as 34 above). A link assembly extends from the foot pedal along the base and then upwardly along the rear of the shell 122 to the upper support frame 128 and the lid 132, and can be the same as the link assembly in FIGS. 1-2E. The link assembly includes a pair of link rods 140, with each rod 140 extending from the base upwardly along one edge of the rear of the shell 122 to the upper support frame 128 so that each rod 140 is aligned with a rear corner of the lid 132 (see FIG. 3). Only one link rod 140 and its accompanying hinge components are shown in FIGS. 4A-5B, but both pairs of link rods 140 and their accompanying hinge components are the same.

Figure 4A:
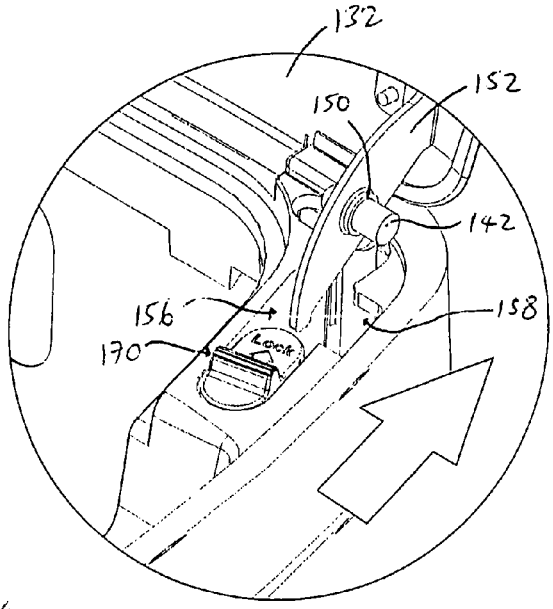
FIGS. 4A-4B are enlarged sectional views of the section 4 in FIG. 3 illustrating the operation of the locking mechanism of the lid for the trash can assembly of FIG. 3.
Figure 4B:
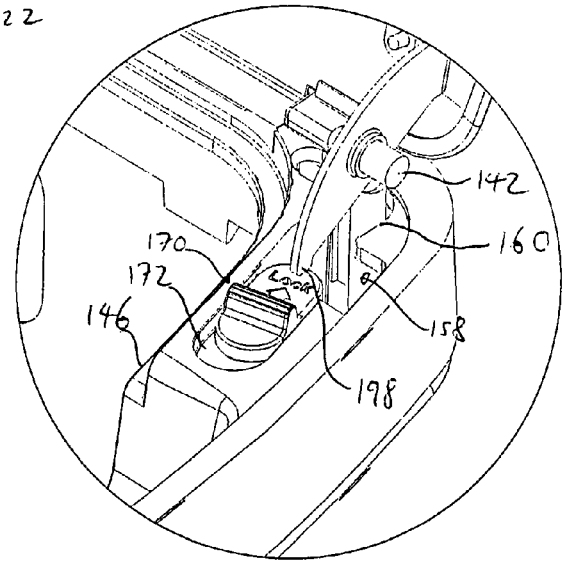

Referring to FIGS. 4A-4B, each link rod 140 has a hooked end 142 that is adapted to be inserted through a hole 150 in an L-shaped bracket 152 that is fixedly secured (e.g., by screws) to the underside of the lid 132 at a corner of the lid 132. Thus, pressing and releasing the pedal will cause the upper hooked end 142 of each link rod 140 to move up and down, respectively, thereby opening and closing (via the force of gravity) the lid 132, which is well-known in the art.

The support frame 128 has an L-shaped slot 156 provided at each rear corner of the shell 122. Each slot 156 is sized and configured to allow the bracket 152 to extend therethrough and into the interior of the shell 122. In particular, each slot 156 has a leg section 158 that has a width which is slightly greater than the length of the hooked end 142 to allow the hooked end 142 to pass therethrough as the lid 132 is raised and lowered. Each slot 156 also has an elongate section 160 extending from the leg section 158.

Figure 5A:
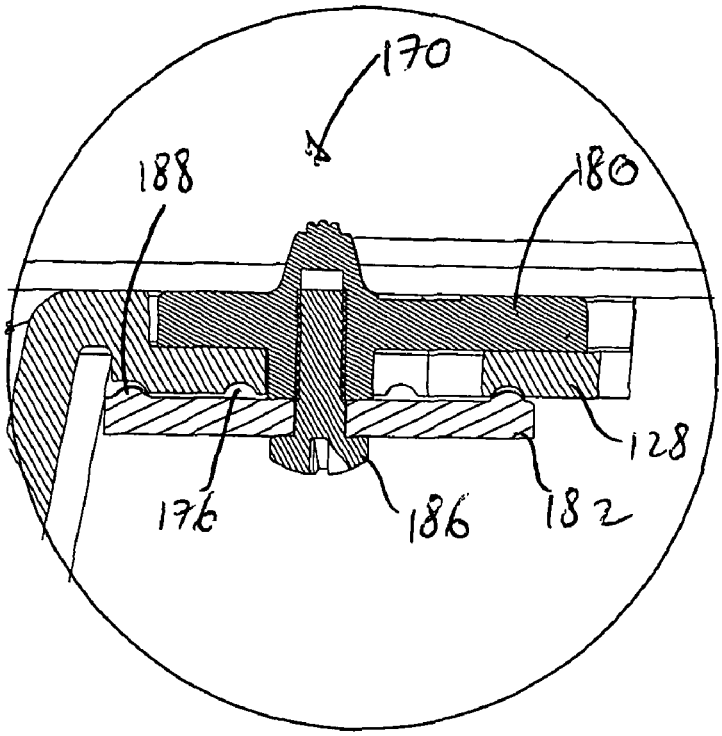
FIGS. 5A-5B are cross-sectional views of the locking mechanism of the lid for the trash can assembly of FIG. 3.
Figure 5B:
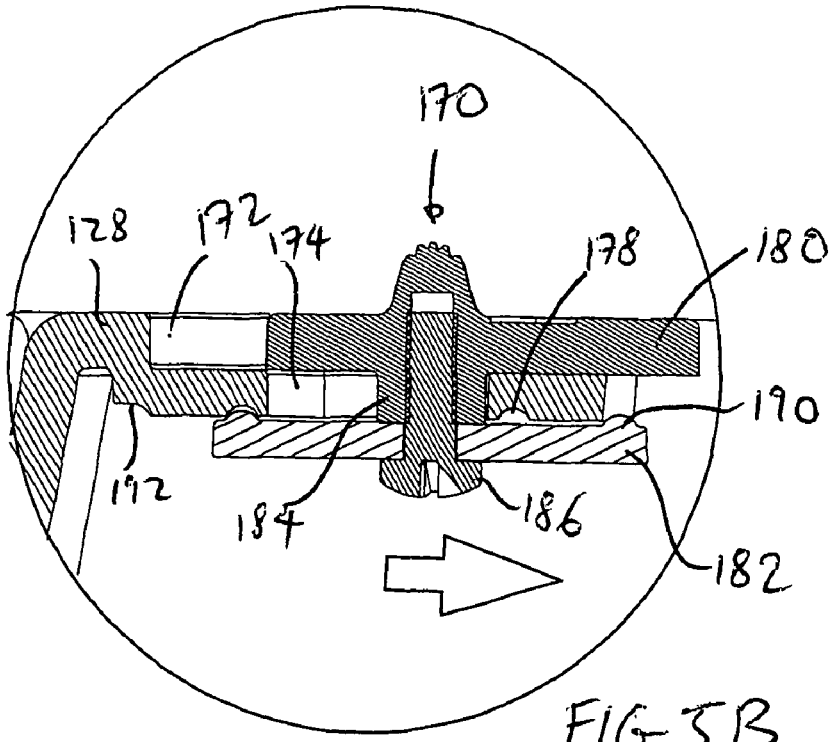

The upper support frame 128 also has an annular recessed wall 146, with one or more cut-outs or grooves 148 spaced-apart about the wall 146. The grooves 148 can be the same as the grooves 48 described above. A sliding lock member 170 is provided on the support frame 128. Referring also to FIGS. 5A-5B, the support frame 128 has an elongated recess 172 on its top surface, and an opening 174 extending through the support frame 128 not far from the location of the slot 156. The bottom surface of the support frame 128 has two concave recesses 176, 178 provided on either side of the opening 174.

The lock member 170 includes a sliding piece 180 and a bottom piece 182. The sliding piece 180 has a central portion 184 that extends through a part of the opening 174, where it is secured to the bottom piece 182 by a threaded bolt 186 which extends through an opening in the bottom piece 182 and a threaded bore in the central portion 184. The width of the opening 174 defines the extent of possible movement by the central portion 184 and its lock member 170. Two convex bumps 188 and 190 are provided on the top surface of the bottom piece 182 at opposite ends thereof, extending towards the support frame 128. In use, the user can slide the sliding member 180 back and forth inside the recess 172 between a retracted position (see FIGS. 4A and 5A) and an extended position (see FIGS. 4B and 5B). When the sliding member 180 is in the retracted position, the bump 190 is seated inside the recess 178, and the bump 188 is positioned in a recessed region 192 at the bottom of the support frame 128. When the sliding member 180 is in the extended position, the bump 188 is seated inside the recess 176, and the bump 190 is positioned in the slot 156. The retention of a bump 188 or 190 inside a recess 176 or 178 functions to secure the sliding piece 180 in either the extended or the retracted position.

FIGS. 4A-5B illustrate how the lid 132 can be retained in an open position. During normal use of the trash can assembly 120, the sliding member 180 is in the retracted position shown in FIGS. 4A and 5A. With the lock member 170 and its sliding member 180 retracted, the bracket 152 can be pivoted uninterrupted through the slot 156 during the opening and closing motions of the lid 132. When a user desires to retain the lid 132 in a raised position, the user raises the lid 132 (e.g., by stepping on the pedal) and while keeping the lid 132 raised, and pushes the sliding member 180 from the retracted position to the extended position (FIGS. 4B and 5B) so that a portion of the sliding member 180 protrudes into the slot 156. The user then releases the lid 132, at which time the force of gravity will cause the lid 132 to lower itself until the bottom end 198 of the bracket 152 is seated on top of the extended portion of the sliding member 180. Since the extended portion of the sliding member 180 interferes with the travel path of the bracket 152, it functions to hold the bracket 152 (and the lid 132) in a raised position.

When the user desires to lower the lid 132, the user merely pushes the sliding member 180 from the extended position to the retracted position, clearing the space in the slot 156 for the bracket 152 to fall through, thereby lowering the lid 132.

Alternatively, the trash can assembly 120 can be provided without link rods 140, and without any step pedal. The principles of the embodiment of FIGS. 3-5B can be carried out by using merely the bracket 152 and the lock member 170.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. A trash can assembly, comprising:

a shell having an interior and a top end;

a lid fitted over the top end, the lid having a bottom and having a bracket at the bottom of the lid;

a slot provided adjacent the top of the shell, the bracket moving through the slot as the lid is opened and closed; and a movable lock member provided at the top of the shell, the lock member movable from an extended position where the lock member covers a portion of the slot so that the bracket is prevented from passing through the slot and where the entire bracket is positioned above the lock member, to a retracted position where the lock member is clear of the slot.

2. The assembly of claim 1, further including:

a foot pedal; and a link assembly coupling the foot pedal and the lid, the link assembly including a rod that is coupled to the bracket.

3. The assembly of claim 1, further including a support frame provided at the top end of the shell, the support frame made of a different material than the shell, with the slot provided in the support frame.

4. The assembly of claim 3, wherein the lock member is movable along the support frame.

5. The assembly of claim 1, wherein the bracket is positioned inside the interior of the shell when the lid is closed.

6. The assembly of claim 2, wherein the rod includes a hooked end that is pivotably coupled to the bracket.

7. The assembly of claim 4, wherein the support frame has an opening, an upper surface and a lower surface, and wherein the lock member includes:

a sliding member positioned along the upper surface, and having a central portion extending through the opening of the support frame; and a bottom piece positioned along the lower surface, the lower surface having at least one bump extending towards the lower surface, with the lower surface having a recess that receives the at least one bump when the lock member is in the retracted position; and wherein the central portion connects the sliding member with the bottom piece.

8. A trash can assembly, comprising:

a shell having an interior and a top end;

a foot pedal;

a lid fitted over the top end, the lid having a bottom and a having bracket at the bottom of the lid;

a link assembly coupling the foot pedal and the lid, the link assembly including a rod that is coupled to the bracket;

a support frame provided at the top end of the shell, with a slot provided in the support frame, the bracket moving through the slot as the lid is opened and closed, and positioned inside the interior of the shell when the lid is closed; and a movable lock member movable along the support frame, the lock member movable from an extended position where the lock member covers a portion of the slot so that the bracket is prevented from passing through the slot and where the entire bracket is positioned above the lock member, to a retracted position where the lock member is clear of the slot.

9. A trash can assembly, comprising:

a shell having an interior and a top end;

a foot pedal;

a lid fitted over the top end, the lid having a bottom and a having bracket at the bottom of the lid;

a link assembly coupling the foot pedal and the lid, the link assembly including a rod that is coupled to the bracket;

a support frame provided at the top end of the shell, with a slot provided in the support frame, the bracket moving through the slot as the lid is opened and closed, and positioned inside the interior of the shell when the lid is closed;

a movable lock member movable along the support frame, the lock member movable from an extended position where the lock member covers a portion of the slot so that the bracket is prevented from passing through the slot, to a retracted position where the lock member is clear of the slot; and wherein the support frame has an opening, an upper surface and a lower surface, and wherein the lock member includes:

a sliding member positioned along the upper surface, and having a central portion extending through the opening of the support frame; and a bottom piece positioned along the lower surface, the lower surface having at least one bump extending towards the lower surface, with the lower surface having a recess that receives the at least one bump when the lock member is in the retracted position; and wherein the central portion connects the sliding member with the bottom piece.

10. The assembly of claim 1, further including a support frame provided at the top end of the shell, with the slot provided in the support frame, with an elongated recess provided in the support frame adjacent the slot, and with the lock member retained for sliding motion in the elongated recess.

11. The assembly of claim 1, wherein the bracket is seated on the lock member when the lock member is in the extended position.

12. The assembly of claim 1, wherein the entire bracket is prevented from passing through the slot when the lock member is in the extended position.

13. The assembly of claim 8, wherein an elongated recess is provided in the support frame adjacent the slot, with the lock member retained for sliding motion in the elongated recess.

14. The assembly of claim 8, wherein the bracket is seated on the lock member when the lock member is in the extended position.

15. The assembly of claim 8, wherein the entire bracket is prevented from passing through the slot when the lock member is in the extended position.

16. A trash can assembly, comprising:

a shell having an interior and a top end;

a lid fitted over the top end, the lid having a bottom and a bracket secured to the bottom of the lid;

a support frame provided at the top end of the shell, with a slot provided in the support frame, the bracket moving through the slot as the lid is opened and closed, the support frame having an opening, an upper surface and a lower surface; and a movable lock member movable along the support frame, the lock member movable from an extended position where the lock member covers a portion of the slot, to a retracted position where the lock member is clear of the slot, wherein the lock member includes:

a sliding member positioned along the upper surface, and having a central portion extending through the opening of the support frame; and a bottom piece positioned along the lower surface, the lower surface having at least one bump extending towards the lower surface, with the lower surface having a recess that receives the at least one bump when the lock member is in the retracted position; and wherein the central portion connects the sliding member with the bottom piece.

* * * * *